US006056466A

United States Patent [19]

Johnson et al.

[11] Patent Number: 6,056,466

[45] Date of Patent: May 2, 2000

[54] TOOTHBRUSH WITH A REFILLABLE TOOTHPASTE CHAMBER

[76] Inventors: Jeff Johnson; Jeremy Steele, both of 4330 Stow Rd., Stow, Ohio 44224

[21] Appl. No.: 09/074,014

[22] Filed: May 7, 1998

[51] Int. Cl.[7] ..... A46B 11/02

[52] U.S. Cl. ..... 401/188 R; 401/187; 401/270

[58] Field of Search ..... 401/187, 188 R, 401/191, 270, 268, 282, 188 A, 189

[56] References Cited

U.S. PATENT DOCUMENTS

| | | | |
|---|---|---|---|
| 637,522 | 11/1899 | McGinnis . | |
| 2,441,520 | 5/1948 | Ulvick | 15/138 |
| 2,631,762 | 3/1953 | Perwas | 401/188 X |
| 2,790,190 | 4/1957 | Mastrandrea | 401/188 X |
| 2,900,650 | 8/1959 | Rivero | 401/191 X |
| 4,062,635 | 12/1977 | Teh-Sheng | 401/175 |
| 4,128,349 | 12/1978 | Del Bon | 401/151 |
| 4,265,560 | 5/1981 | Spica | 401/183 |
| 4,583,563 | 4/1986 | Turner | 132/84 R |
| 4,844,641 | 7/1989 | Grosfilley et al. | 401/176 |
| 4,919,156 | 4/1990 | Gipson | 132/309 |
| 5,407,287 | 4/1995 | Braun et al. | 401/176 |
| 5,439,014 | 8/1995 | Moussa | 132/311 |
| 5,462,377 | 10/1995 | Martine, Jr. et al. | 401/185 |

FOREIGN PATENT DOCUMENTS

| | | | |
|---|---|---|---|
| 2600513 | 12/1987 | France | 401/188 |
| 913371 | 12/1962 | United Kingdom | 401/188 |

*Primary Examiner*—David J. Walczak
*Attorney, Agent, or Firm*—John D. Gugliotta

[57] ABSTRACT

A toothbrush with a refillable toothpaste chamber which provides for the storage of toothpaste of choice within the handle section is disclosed. The toothpaste tube mates with a matching threaded connection on the lower surface of the handle to allow filling of the present invention with no or minimal wasted toothpaste. When the conventional toothpaste tube is removed, a pressurizing pump is installed to allow the user to pressurize the toothpaste chamber. To dispense the toothpaste product, the user simply activates a valve to allow the flow of toothpaste up the handle of the toothbrush where it exits from within the brush assembly of the toothbrush. The toothpaste chamber holds a sufficient amount of toothpaste to allow for several tooth brushing cycles or for a period of use during short travel times. When the internal supply is depleted, the present invention is refilled by repeating the above process.

8 Claims, 4 Drawing Sheets

TOOTHBRUSH WITH A REFILLABLE TOOTHPASTE CHAMBER

BACKGROUND OF THE INVENTION

1. Field of the Invention

The present invention relates generally to dental care instruments and more particularly, to a toothbrush with a refillable toothpaste chamber.

2. Description of the Related Art

The act of brushing one's teeth with a toothbrush is one commonly known to all and is necessary to maintain good dental hygiene. However, there is, and has been, many problems associated with brushing one's teeth using this arrangement. Perhaps the biggest of these problems is that it is necessary to always have both the toothbrush and the toothpaste in one's possession before beginning the act of brushing one's teeth. This may pose a problem especially during travel, where one may forget one or the other, or space may be at a premium with regards to bringing along personal care appliances.

The previous art consists of many examples to aid in the act of brushing one's teeth. In U.S. Pat. No. 5,462,377, issued in the name of Martinez, Jr. et al., a toothbrush with integral pump bellows pre-filled with toothpaste is disclosed. This invention suffers from the fact that the consumer is limited to the toothpaste that is supplied with the toothbrush. Clearly this is not acceptable to those users who use more than the average amount of toothpaste and are forced to dispose of the toothbrush while it is still in satisfactory shape. Adversely, those users who wear out the toothbrush before the toothpaste is depleted suffer monetary losses as the remaining toothpaste is wasted.

In U.S. Pat. No. 5,439,014 issued in the name of Moussa, an apparatus for dispensing of toothpaste internally through the handle of a toothbrush is disclosed. A problem associated with an apparatus made in accordance with this disclosure is that the user has no control over the flow of the toothpaste and must rely on the force of gravity to pull the toothpaste from within the handle.

In U.S. Pat. No. 5,407,287, issued in the name of Braun et al., a toothbrush with a pressurized toothpaste container is disclosed. This invention utilizes pressurized gas to force the toothpaste out. This arrangement relies on complex mechanical features and is not cost effective for the limited lifetime of toothbrushes. Additionally, an apparatus manufactured in accordance with this disclosure forces the consumer to use only toothpaste that is packaged in pre-pressurized containers or is available for pressurization after purchase by the final consumer. Once again this limits the consumer to the type of toothpaste used.

In U.S. Pat. No. 4,919,156, issued in the name of Gipson, a combination dental device is disclosed. This device, while containing a refillable toothpaste cartridge, does not resemble a conventional toothbrush. This fact may lead to resistance to purchase such a device on the pail of the consumer.

In U.S. Pat. No. 4,844,641, issued in the name of Grosfilley et al., and U.S. Pat. No. 2,649,959, issued in the name of Hallahon, disposable toothbrushes are disclosed. While such disclosures possess an internal charge of toothpaste, it is a one time charge only and is designed to be disposed after a single use. While such inventions may prove useful for emergencies or during short travel periods, it is not cost effective for daily use or during periods of extended travel, as the space required to carry the necessary number of disposable toothbrushes would be great.

In U.S. Pat. 4,583,563, issued in the name of Turner, a toothbrush with a replaceable cartridge is disclosed. This disclosure suffers; from the same disadvantage as the Braun et al. disclosure aforementioned described. That is, the consumer is limited to toothpaste that is available or is packaged in the disposable cartridge on a per unit basis by the final customer.

In U.S. Pat. No. 4,265,560, issued in the name of Spica, another disposable toothbrush is disclosed. While an invention made in accordance with this disclosure allows for more than use, the uses are of a fairly limited number and once again the consumer is forced to use the type of toothpaste that is packaged with the toothbrush and not necessarily the type of toothpaste the customer usually uses.

In U.S. Pat. No. 4,128,349, issued in the name of Del Bon, a toothbrush which carries its own charge of toothpaste is disclosed. While an invention made in accordance with this disclosure allows for the consumer to utilize their preferred brand of toothpaste, it comprises many individual pieces and is not suitable for a cost-effective product produced by mass production methods. The multitude of pieces along with the tight tolerances involved do not allow for ease of cleaning nor continuous operation without clogging.

In U.S. Pat. No. 4,062,635, issued in the name of The-Sheng, U.S. Pat. No. 3,995,648, issued in the name of Kuryla, and U.S. Pat. No, 637,522, issued in the name of McGinnis, toothbrushes which allow the customer to utilize their own toothpaste are disclosed. However, a disadvantage associated with these disclosures is that the user must dissemble the toothbrushes to refill them. This exposes many internal components coated with the previous charge of toothpaste and presents the user with an unwieldy assortment of components that lead to contamination when set down during the disassembly and reassembly process.

Finally, in U.S. Pat. No. 2,441,520, issued in the name of Ulvick, a toothbrush with its own charge of pre-supplied toothpaste in the handle is disclosed. The user however is forced to rotate the handle with relation to the head to dispense toothpaste and then rotate it to the other direction to use it. This factor may not be acceptable during use as the act of brushing one's teeth may place rotational forces on the handle of the toothbrush thus causing it to inadvertently operate. Additionally, once again the user is forced to use whatever toothpaste is supplied with the toothbrush.

Consequently, a need has been felt for providing a device and method which overcomes the problems cited above.

SUMMARY OF THE INVENTION

It is therefore an object of the present invention to provide an improved toothbrush with a refillable toothpaste chamber.

It is therefore another object of the present invention to provide an improved toothbrush with a refillable toothpaste chamber that allows for the storage of toothpaste of the user's choice within said toothpaste chamber of said toothbrush.

It is therefore yet another object of the present invention to provide an improved toothbrush with a refillable toothpaste chamber that permits the user to only carry the invention on travel trips and not be burdened with the toothpaste tube or the loss of packing space used by said toothpaste tube.

It is therefore another object of the present invention to provide an improved toothbrush with a refillable toothpaste chamber that allows the user to dispense toothpaste onto the brush portion of the present invention with a minimum of physical action. Such an object is deemed particularly advantageous when used by an individual with a physical disability which limits the usage of one's hands.

It is therefore yet another object of the present invention to provide an improved toothbrush with a refillable toothpaste chamber that allows the user to refill said toothbrush from a conventional toothpaste tube with no spillage or associated waste.

Briefly described according to the preferred embodiment of the present invention, an improved toothbrush with a refillable toothpaste chamber which provides for the storage of toothpaste of choice within the handle section is disclosed. The toothpaste tube mates with a matching threaded connection on the lower surface of the handle to allow filling of the present invention with no or minimal wasted toothpaste. When the conventional toothpaste tube is removed, a pressurizing pump is installed to allow the user to pressurize the toothpaste chamber. To dispense the toothpaste product, the user simply activates a valve to allow the flow of toothpaste up the handle of the toothbrush where it exits from within the brush assembly of the toothbrush. The toothpaste chamber holds a sufficient amount of toothpaste to allow for several tooth brushing cycles or for a period of use during short travel times. When the internal supply is depleted, the present invention is refilled by repeating the above process.

It is a feature of the present invention to provide a device that can be easily produced using existing technology, materials and assembly techniques.

It is yet another feature of the present invention to provide a device that encourages children as well as adults to brush their teeth by offering a novel apparatus to accomplish the tooth brushing activity.

Another advantage of the present invention is that it is simple, and therefore, inexpensive to manufacture. This savings, if passed on to the consumer, may influence the public to utilize such a device. A simple design also increases product reliability and useful product lifetime.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a toothbrush with refillable toothpaste chamber.

The best mode for carrying out the invention is presented in terms of its preferred embodiment, herein depicted within the Figures.

1. Detailed Description of the Figures

Figure 1:
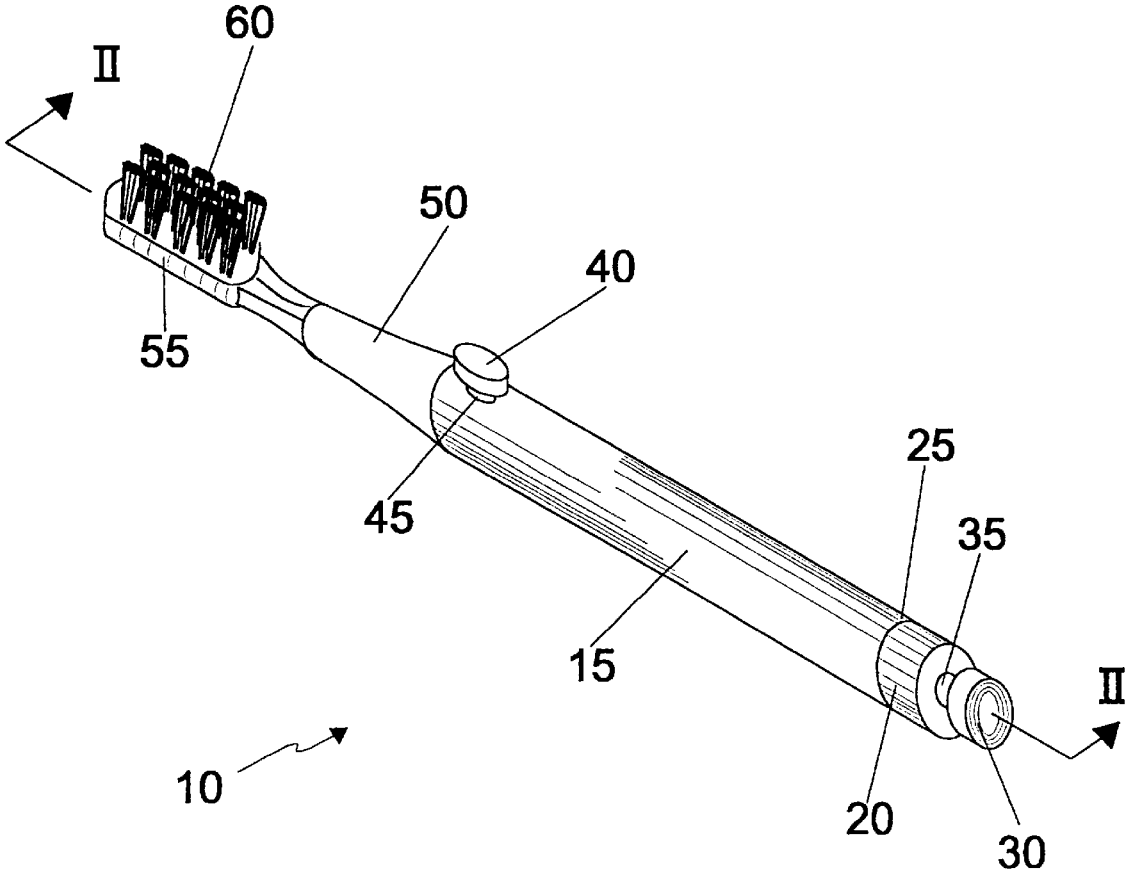
FIG. 1 is a perspective view of a toothbrush with a refillable toothpaste chamber according to a preferred embodiment of the present invention.

Referring now to FIG. 1, a perspective view of a toothbrush with refillable toothpaste chamber 10 according to a preferred embodiment of the present invention is disclosed. A base assembly 15 forms the handle of the toothbrush with refillable toothpaste chamber 10. The base assembly 15 is generally hollow in nature and will be described in greater detail herein below. A pressurizing cap 20 is located on the lower axial end of the base assembly 15 and is connected by an internally threaded connection, which will be shown in greater detail herein below. The joining of the pressurizing cap 20 to the base assembly 15 is defined by a joining line 25, which indicates the juncture of the two said components and defines the lower end of the base assembly 15 with the pressurizing cap 20 removed. A pressurizing plunger 30 located on the end of a connecting rod 35 is provided as an integral component of the pressurizing cap 20. The purpose of the pressurizing plunger 30 is to allow the user of the toothbrush with refillable toothpaste chamber 10 to pressurize the contents of the base assembly 15 when the pressurizing cap 20 is in place. The associated components along with the act of pressurizing the contents will be described in greater detail herein below. Located at the upper axial end of the base assembly 15 is an actuating knob 40 connected to a valve stem 45. The purpose of the actuating knob 40 is to allow for the flow of the pressurized contents of the base assembly 15 to flow up a hollow interconnecting tube 50, through a brush base 55 and onto a bristle section 60 of the toothbrush with refillable toothpaste chamber 10. The flow will be from within the bristle section 60 and emanate in an outward manner. The controlling mechanism as defined by the actuating knob 40, as well as the path taken by the flow of the pressurized contents will be defined in greater detail herein below. It is envisioned that all components of the toothbrush with refillable toothpaste chamber 10 will be manufactured from plastic using an injection molding process, with necessary machining and assembly processes taking place as required. This will allow for cost-effective production using commonly known manufacturing techniques. It is envisioned that many different designs, patterns, and colors will be available, just as with conventional toothbrushes, thus the design as depicted in FIG. 1 is not intended to be a limiting factor.

Figure 2:
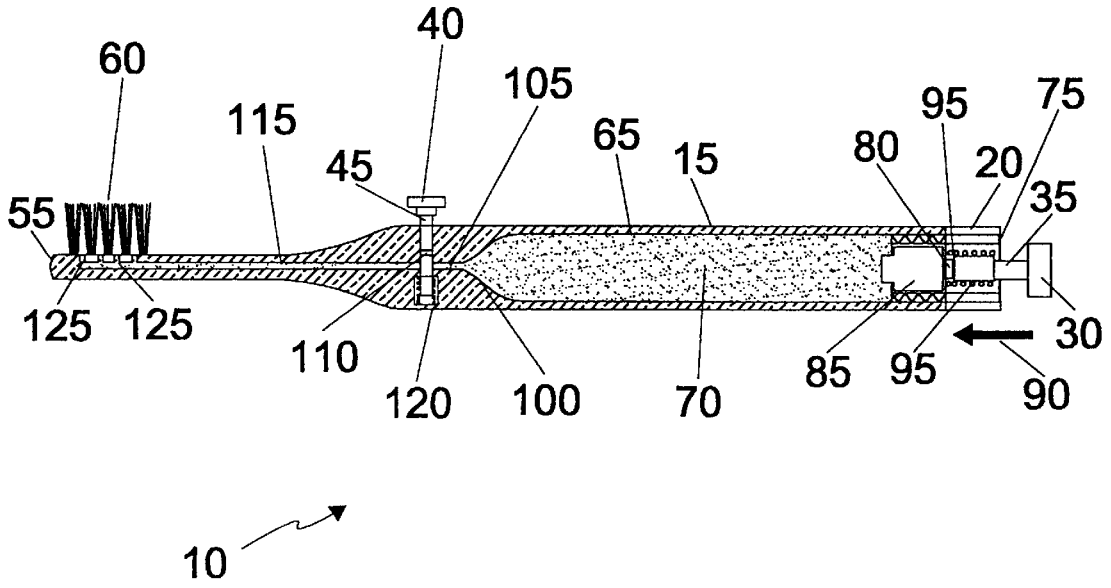
FIG. 2 is a cross-sectional view as seen along a line II—II as seen in FIG. 1.

Referring next to FIG. 2, a cross-sectional view of the toothbrush with refillable toothpaste chamber 10 as seen along a line II—II in FIG. 1 is disclosed. A toothpaste chamber 65, as defined by the walls of the base assembly 15 contains a charge of toothpaste 70. The toothpaste 70 is retained within the toothpaste chamber 65 by the pressurizing cap 20, at its lower axial end, and by the valve stem 45 at its upper end. The pressurizing cap 20 allows for the continuation of the connecting rod 35 through a cover plate 75, where it is physically attached to and restrained by a stop guide 80. The stop guide 80 in turn is connected to a pneumatic pump mechanism 85. The pneumatic pump mechanism 85 draws air in through a circular air gap provided between the cover plate 75 and the connecting rod 35. The pneumatic pump mechanism 85 provides for the pressurization of the toothpaste 70 in a conventional manner. Actuation of the pressurizing plunger 30 as defined by a direction path arrow 90 results in a pressurization charge to the toothpaste 70. When the downward stroke is completed, the user will release the pressurizing plunger 30 and a first spring 95 redirects the connecting rod 35 to its extended normal position as shown. At the opposite end of the toothpaste chamber 65, a cone shaped directing funnel 100 directs the toothpaste 70 into a first tube section 105. A flow orifice 110 located in the valve stem 45, which will be depicted in greater detail herein below, provides for the controlling of toothpaste 70 from the first tube section 105 into a second tube section 115. In its normal extended position as shown, the flow orifice 110 in the valve stem 45 does not line up with the axial path as defined by the first tube section 105 and the second tube section 115, thus no flow takes place. If the user presses the actuating knob 40 of the valve stem 45 inward, a second spring 120 will compress allowing the flow orifice 110 to line up with the axial path as defined by the first tube section 105 and the second tube section 115 and thus allowing the flow of toothpaste 70 to take place. When the user releases the actuating knob 40, the second spring 120 will force the valve stem 45 in an outward, upward direction, thus stopping the flow of toothpaste 70. The self cleaning operation of the flow orifice 110 in the valve stem 45 allows for a simple design that is not prone to clogging or other malfunctions. As the flow of toothpaste 70 continues down the second tube section 115 into the brush base 55 it reaches a plurality of exit ports 125 where it leaves the brush base 55 and permeates the bristle section 60. In this manner the user is afforded the option of only using one hand to apply toothpaste 70 to the bristle section 60. It is envisioned that the toothbrush with refillable toothpaste chamber 10 would have the capability of holding enough toothpaste 70 to allow an individual to brush their teeth approximately 15–20 times. While more or less toothpaste 70 may be retained according to the overall dimensions of the toothbrush with refillable toothpaste chamber 10, it is envisioned that the tradeoffs of a larger capacity would be offset by decreased physical ergonomics of the base assembly 15, thus causing it to be difficult or uncomfortable to hold.

Figure 3:
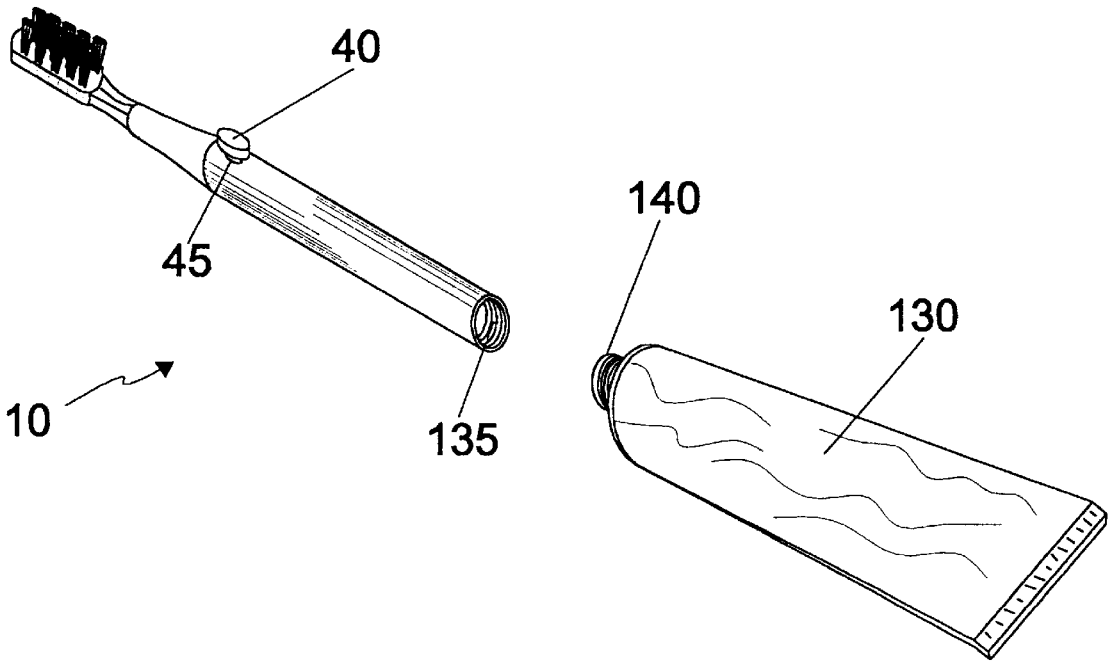
FIG. 3 is a perspective view of the present invention shown in a utilized state with a tube of conventional toothpaste.

Referring now to FIG. 3, a detailed perspective view of the toothbrush with refillable toothpaste chamber 10 shown in a utilized state with a conventional toothpaste tube 130 is depicted. The pressurizing cap 20 (as seen in FIG. 1) has been removed to show how the conventional toothpaste tube 130 would be connected the toothbrush with refillable toothpaste chamber 10 for purposes of refilling the toothpaste chamber 65 (as seen in FIG. 2). A set of internal female threads 135, originally provided for the purposes of capturing and retaining the pressurizing cap 20 (as seen in FIG.1 and FIG. 2) align with and capture a set of external male threads 140 as provided on the conventional toothpaste tube 130. The toothbrush with refillable toothpaste chamber 10 takes advantage of the fact that most external male threads 140 on conventional toothpaste tube 130 are of the same size and type. After the user has completed the tightening of the toothbrush with refillable toothpaste chamber 10 and the conventional toothpaste tube 130 together, the user would release the actuating knob 40 and its respective valve stem 45 to allow any air retained within the toothbrush with refillable toothpaste chamber 10 to be displaced by the new flow of toothpaste 70 (as seen in FIG. 2). The user would then gently squeeze the conventional toothpaste tube 130 in a conventional manner to expel the toothpaste 70 into the toothpaste chamber 65 (as shown in FIG. 2). When the toothbrush with refillable toothpaste chamber 10 is refilled, the user would simply unscrew the conventional toothpaste tube 130 and replace the pressurizing cap 20 (as shown in FIG. 2). This action affords the user little chance of spilling the contents of the conventional toothpaste tube 130 as well as the associated wasted monetary costs of the contents should a spill occur.

Figure 4:
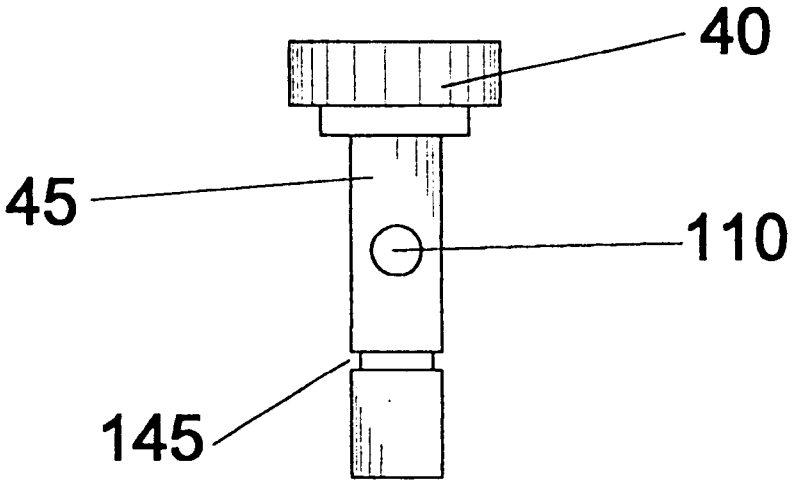
FIG. 4 is a detailed elevational view of the actuator valve as used with the present invention.

Referring next to FIG. 4, an elevational view of the valve stem 45 is shown. The actuating knob 40 is physically attached to the valve stem 45, or is formed as an integral piece. The flow orifice 110 is circular in nature and is located through a diameter of the valve stem 45 at its approximate midpoint as shown. A retaining collar 145 is provided for the second spring 120 (as shown in FIG. 2) to allow for the retention of the valve stem 45 within the body of the toothbrush with refillable toothpaste chamber 10 (as shown in FIG. 2).

Figure 5:
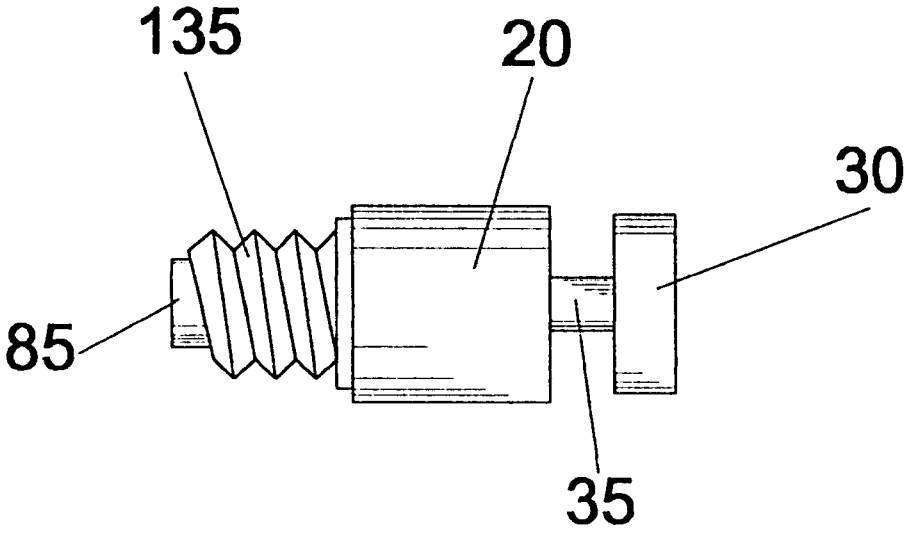
FIG. 5 is a detailed elevational view of the pressurizing cap as used with the present invention.

Referring finally to FIG. 5, an elevational view of the pressurizing cap 20 is disclosed. This clearly shows how the pressurizing plunger 30 is physically attached to the connecting rod 35, or formed as an integral piece. Additionally, the pneumatic pump mechanism 85 is shown slightly protruding from the internal female threads 135. The internal female threads 135 match the diameter and pitch of those threads commonly found on conventional toothpaste tubes.

2. Operation of the Preferred Embodiment

In operation, the present invention can be easily utilized by the common patron of a restaurant or drinking establishment in a simple and effortless manner. To use the present invention with its preferred embodiment can best be described in conjunction with the perspective views of FIG. 1 and FIG. 3, the cross sectional view of FIG. 2, and the elevational views of FIG. 4 and FIG. 5.

To use the present invention, the user would first remove the pressurizing cap 20 from the base assembly 15 of the toothbrush with refillable toothpaste chamber 10. Next the user would remove the conventional cap commonly found on the conventional toothpaste tube 130. The user would then screw the internal female threads 135 of the toothbrush with refillable toothpaste chamber 10 and the external male threads 140 of the conventional toothpaste tube 130 together in a conventional clockwise direction. When the conventional toothpaste tube 130 is fully seated against the joining line 25 of the base assembly 15, the user would depress the valve stem 45 and gently squeeze the conventional toothpaste tube 130 to fill the toothpaste chamber 65 with toothpaste 70. When the toothpaste chamber 65 is filled, the user would release the valve stem 45 and unscrew the conventional toothpaste tube 130 in a manner opposite to that described above. The user would then install the pressurizing cap 20 on the lower axial end of the base assembly 15 in the spot formerly occupied by the conventional toothpaste tube 130. At this point the user is ready to pressurize the toothbrush with refillable toothpaste chamber 10.

The user would pressurize the toothbrush with refillable toothpaste chamber 10 by holding it in their hand with the end possessing the bristle section 60 pointed downward. Next, using one's thumb, repeated pressurizing strokes are applied to the pressurizing plunger 30 in a manner similar to that used with a ball point retractable pen. After a series of strokes the pneumatic pump mechanism 85 will build up an appreciable pressure inside of the toothpaste chamber 65. At this point the user is ready to brush their teeth.

A user would start to brush their teeth by wetting the bristle section 60 under running water if so desired. Next, the user would depress the valve stem 45 by pressing down on the actuating knob 40 until an adequate quantity of toothpaste 70 has been expelled through the exit ports 125. Once the adequate quantity has been reached, the user would release the valve stem 45 and commence brushing their teeth in a normal conventional mariner. When completed the user would rinse the toothbrush with refillable toothpaste chamber 10 in a conventional manner. This process of applying toothpaste 70 to the bristle section 60 would be repeated whenever the user wished to brush their teeth. If adequate pressure is not available, the user would pressurize the toothbrush with refillable toothpaste chamber 10 by applying repeated strokes as previously described. If the internal quantity of toothpaste 70 stored within the toothpaste chamber 65 is depleted, the user would refill the toothbrush with refillable toothpaste chamber 10 in the manner as previously described and the above-mentioned process would repeat in its entirety.

While the aforementioned description is envisioned as being utilized with toothpaste for dental hygiene purposes, it should be understood that it is well within the scope of the present invention that it may be used with other materials, including but not limited to cleaners, polishers, paints and the like.

The foregoing description is included to illustrate the operation of the preferred embodiment and is not meant to limit the scope of the invention. The scope of the invention is to be limited only by the following claims.

COMPONENT LIST

10 toothbrush with refillable toothpaste chamber
15 base asembly
20 pressurizing cap
25 joining line
30 pressurizing plunger
35 connecting rod
40 actuating knob
45 valve system
50 hollow interconnecting tube
55 brush base
60 bristle section
65 toothpaste chamber
70 toothpaste
75 cover plate
80 stop guide
85 pneumatic pump mechanism
90 direction path arrow
95 first spring
100 cone shaped directing funnel
105 first tube section
110 flow orifice
115 second tube section
120 second spring
125 exit ports
130 conventional toothpaste tube
135 internal female threads
140 external male threads
145 retaining collar

What is claimed is:

1. A pressurized, refillable toothbrush for dispensing toothpaste contained therein comprising:

a elongated handle having a hollow interior cavity in which to store toothpaste, said elongated handle having a filling end opposite a brush end, said filling end comprising a circular aperture in fluid communication with said hollow interior cavity, said brush end being closed, having a generally flat bristle surface and being in fluid communication with said hollow interior cavity;

a brush element coupled to said bristle surface, said brush element including a plurality of bristles protruding in a generally outward, perpendicular direction therefrom;

at least one dispensing aperture located and spaced about said bristle surface between said bristles, said at least one dispensing aperture providing fluid connectivity with said hollow interior cavity for dispensing said toothpaste therethrough;

a pressurizing cap removably attached to said filling end including a plunger pressurization means for increasing the air pressure inside the hollow interior cavity; and a toothpaste release valve located along said elongated handle at a position prior to said brush end, said toothpaste release valve isolating said hollow interior cavity from said brush end, thus providing control of the flow of said toothpaste therethrough.

2. The toothbrush in claim 1, wherein said pressurizing cap further comprises a threaded attachment means located on an annular surface thereof and wherein said open end further comprises a threaded attachment means located on an annular surface thereof, said pressurizing cap threadably engaging with said filling end allowing said hollow interior cavity to be filled with said toothpaste when said pressurizing cap is removed and allowing said filling end to be sealed when said pressurizing cap is secured to said open end by said threaded attachment means.

3. The toothbrush in claim 1, wherein open end further comprises a tube attaching means consisting of a threaded attachment means located on the interior annular surface of said filling end, said tube attaching means having a thread pitch and angle generally equivalent to that of conventional toothpaste tubes such that a conventional toothpaste tube can be threadably attached thereto in order to facilitate filling said hollow interior cavity.

4. The toothbrush in claim 1, wherein said elongated handle further comprises a grasping region and a neck region, said neck region connecting said brush end to said grasping region, said grasping region being generally cylindrical in shape and said neck region tapering from said grasping region toward said brush end.

5. The toothbrush in claim 1, wherein said plunger pressurization means further comprises a hermetically sealed air transfer pumping device that forces ambient air into said hollow interior cavity, creating a positive pressure therein.

6. The toothbrush in claim 1, wherein said toothpaste release valve further comprises a spring biased pushbutton actuating means wherein said toothpaste release valve is closed when said spring biased pushbutton is in the relaxed position, and wherein upon depressing said spring biased pushbutton, said toothpaste release valve is opened, establishing fluid connectivity between said hollow interior cavity and said brush element, allowing said toothpaste to flow through said at least one dispensing aperture.

7. The toothbrush in claim 1, wherein said toothpaste comprises a generally fluid consistency facilitating flow through said hollow interior cavity and through said at least one dispensing aperture.

8. The toothbrush in claim 1, wherein said elongated handle is constructed of a strong, durable material having a generally rigid quality.

* * * * *